US008286369B2

(12) United States Patent
Dittmer et al.

(10) Patent No.: US 8,286,369 B2
(45) Date of Patent: Oct. 16, 2012

(54) DEVICE FOR DETERMINING THE CONDUCTANCE OF LAUNDRY, DRYERS AND METHOD FOR PREVENTING DEPOSITS ON ELECTRODES

(75) Inventors: Lothar Dittmer, Berlin (DE); Harald Moschütz, Grossbeeren (DE); Thomas Nawrot, Berlin (DE); Andreas Ziemann, Potsdam (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/014,885

(22) Filed: Jan. 27, 2011

(65) Prior Publication Data

US 2011/0119951 A1 May 26, 2011

Related U.S. Application Data

(62) Division of application No. 10/539,453, filed as application No. PCT/EP03/14177 on Dec. 20, 2003, now Pat. No. 7,975,400.

(30) Foreign Application Priority Data

Dec. 20, 2002 (DE) ..... 102 60 149

(51) Int. Cl.
*F26B 19/00* (2006.01)

(52) U.S. Cl. ..... 34/528; 34/535; 34/606; 34/555; 73/75; 204/560; 313/25; 219/501; 219/533; 8/159; 8/138

(58) Field of Classification Search ..... 34/89, 528, 34/535, 606, 549, 543, 555; 73/75; 8/159, 8/138; 219/501, 553; 204/560; 313/25; 392/269

See application file for complete search history.

(56) References Cited

U.S. PATENT DOCUMENTS

| | | | | |
|---|---|---|---|---|
| 1,413,877 A | | 4/1922 | Schmidt | |
| 2,109,130 A | | 2/1938 | Fisher | |
| 2,109,131 A | | 2/1938 | Fisher | |
| 2,384,660 A | | 9/1945 | Ward | |
| 2,387,292 A | | 10/1945 | Preston | |
| 2,399,964 A | | 5/1946 | Ward | |
| 2,511,839 A | * | 6/1950 | Frye | 34/255 |
| 2,513,431 A | | 7/1950 | Sell | |
| 2,643,463 A | | 6/1953 | Grantham | |
| 2,820,304 A | | 1/1958 | Stanley | |
| 3,031,772 A | | 5/1962 | Sasnett | |
| 3,059,693 A | | 10/1962 | Hotchkiss | |
| 3,073,161 A | | 1/1963 | Crabtree | |

(Continued)

FOREIGN PATENT DOCUMENTS

FR 2820304 A 8/2002

(Continued)

*Primary Examiner* — Stephen Michael Gravini
(74) *Attorney, Agent, or Firm* — James E. Howard; Andre Pallapies

(57) ABSTRACT

A device for determining the conductance of laundry in a drier. The device comprises at least two electrodes and means for dissipating heat from at least one part of at least one of said electrodes. The invention further relates to a drier comprising at least one area for receiving laundry and at least two electrodes for measuring the conductance of the laundry, at least one of the electrodes at least partly bordering said receiving area. Means for cooling at least one part of at least one of the electrodes are also provided inside the drier. Also disclosed is a method for preventing the formation of layers on electrodes used for measuring conductance in a drier.

20 Claims, 5 Drawing Sheets

U.S. PATENT DOCUMENTS

| | | | | | |
|---|---|---|---|---|---|
| 3,100,521 | A | | 8/1963 | Deubel | |
| 3,122,426 | A | | 2/1964 | Horecky | |
| 3,141,957 | A | | 7/1964 | Kelm | |
| 3,186,105 | A | | 6/1965 | Connaught et al. | |
| 3,189,484 | A | * | 6/1965 | Sundman | 427/58 |
| 3,197,884 | A | | 8/1965 | Smith | |
| 3,200,511 | A | | 8/1965 | Smith | |
| 3,221,417 | A | * | 12/1965 | Mellinger | 34/528 |
| 3,260,104 | A | | 7/1966 | King | |
| 3,261,389 | A | | 7/1966 | Milan et al. | |
| 3,266,167 | A | | 8/1966 | Francis | |
| 3,277,949 | A | * | 10/1966 | Walbridge | 431/6 |
| 3,284,918 | A | | 11/1966 | Malecki et al. | |
| 3,286,363 | A | | 11/1966 | Grimshaw | |
| 3,287,817 | A | | 11/1966 | Smith | |
| 3,304,621 | A | | 2/1967 | Nelson | |
| 3,324,568 | A | | 6/1967 | Nelson et al. | |
| 3,327,403 | A | | 6/1967 | Hood | |
| 3,330,686 | A | | 7/1967 | Rose | |
| 3,335,501 | A | | 8/1967 | Janke et al. | |
| 3,338,288 | A | | 8/1967 | Walker | |
| 3,343,272 | A | | 9/1967 | Janke et al. | |
| 3,351,725 | A | | 11/1967 | Gibson | |
| 3,360,092 | A | | 12/1967 | McConnell | |
| 3,393,039 | A | | 7/1968 | Eldridge et al. | |
| 3,394,467 | A | * | 7/1968 | Janke | 34/532 |
| 3,398,460 | A | | 8/1968 | Elders | |
| 3,399,948 | A | * | 9/1968 | Myers et al. | 431/68 |
| 3,402,478 | A | | 9/1968 | Hetrick | |
| 3,404,465 | A | | 10/1968 | Charamond et al. | |
| 3,405,452 | A | | 10/1968 | Candor et al. | |
| 3,409,994 | A | | 11/1968 | Menk | |
| 3,417,480 | A | * | 12/1968 | Thunander | 34/528 |
| 3,419,708 | A | | 12/1968 | Anthony et al. | |
| 3,432,938 | A | | 3/1969 | Miller | |
| 3,436,838 | A | | 4/1969 | Helfrich | |
| 3,457,335 | A | | 7/1969 | Elliott | |
| 3,460,267 | A | | 8/1969 | Lorenz | |
| 3,470,716 | A | | 10/1969 | Candor et al. | |
| 3,471,938 | A | | 10/1969 | Elders | |
| 3,471,939 | A | | 10/1969 | Janke | |
| 3,475,830 | A | * | 11/1969 | Botts et al. | 34/533 |
| 3,484,177 | A | | 12/1969 | Florio et al. | |
| 3,488,131 | A | | 1/1970 | Harter et al. | |
| 3,491,456 | A | | 1/1970 | Candor et al. | |
| 3,491,458 | A | | 1/1970 | Elders et al. | |
| 3,497,964 | A | | 3/1970 | Elders | |
| 3,499,230 | A | * | 3/1970 | Slugantz | 34/533 |
| 3,508,850 | A | | 4/1970 | Good | |
| 3,521,377 | A | | 7/1970 | Janke | |
| RE26,957 | E | | 9/1970 | McConnell | |
| 3,543,408 | A | | 12/1970 | Candor et al. | |
| 3,545,096 | A | | 12/1970 | Robandt et al. | |
| 3,546,783 | A | | 12/1970 | Candor et al. | |
| 3,575,193 | A | | 4/1971 | Niewyk et al. | |
| 3,599,342 | A | | 8/1971 | Cotton | |
| 3,603,805 | A | | 9/1971 | Apel | |
| 3,613,253 | A | | 10/1971 | Smith | |
| 3,613,254 | A | | 10/1971 | Smith | |
| 3,621,293 | A | * | 11/1971 | Heidtmann | 327/428 |
| 3,647,196 | A | | 3/1972 | Cotton | |
| 3,651,579 | A | | 3/1972 | Smith | |
| 3,660,909 | A | | 5/1972 | Willcox | |
| 3,667,130 | A | | 6/1972 | Candor et al. | |
| 3,691,097 | A | | 9/1972 | Stiles et al. | |
| 3,707,856 | A | | 1/1973 | Niewyk et al. | |
| 3,710,138 | A | | 1/1973 | Cotton | |
| 3,714,717 | A | | 2/1973 | Beard et al. | |
| 3,733,712 | A | | 5/1973 | Smith | |
| 3,757,426 | A | | 9/1973 | Candor et al. | |
| 3,782,001 | A | | 1/1974 | Cotton | |
| 3,818,604 | A | | 6/1974 | Offutt et al. | |
| 3,822,482 | A | | 7/1974 | Cotton | |
| 3,824,476 | A | | 7/1974 | Cotton | |
| 3,824,477 | A | | 7/1974 | Cotton | |
| 3,859,036 | A | * | 1/1975 | Schantz | 431/263 |
| 3,968,421 | A | | 7/1976 | Marcade | |
| 4,107,026 | A | | 8/1978 | Freeman | |
| 4,168,222 | A | | 9/1979 | Freeman | |
| 4,170,529 | A | | 10/1979 | Freeman | |
| 4,206,552 | A | | 6/1980 | Pomerantz et al. | |
| 4,207,153 | A | | 6/1980 | Flood | |
| 4,207,158 | A | | 6/1980 | Freeman | |
| 4,209,915 | A | | 7/1980 | Keuleman et al. | |
| 4,245,146 | A | | 1/1981 | Shioi et al. | |
| 4,260,872 | A | | 4/1981 | Brodmann et al. | |
| 4,298,789 | A | | 11/1981 | Eichelberger et al. | |
| 4,338,730 | A | | 7/1982 | Tatsumi et al. | |
| 4,385,451 | A | | 5/1983 | Wesley | |
| 4,385,452 | A | | 5/1983 | Deschaaf | |
| 4,422,129 | A | | 12/1983 | Briant et al. | |
| 4,422,247 | A | | 12/1983 | Deschaaf | |
| 4,470,204 | A | | 9/1984 | Wesley | |
| 4,475,030 | A | | 10/1984 | Bailey | |
| 4,477,982 | A | | 10/1984 | Cotton | |
| 4,520,259 | A | | 5/1985 | Schoenberger | |
| 4,538,899 | A | | 9/1985 | Landa et al. | |
| 4,546,554 | A | | 10/1985 | Bullock et al. | |
| 4,622,759 | A | | 11/1986 | Abe et al. | |
| 4,649,654 | A | | 3/1987 | Hikino et al. | |
| 4,656,455 | A | | 4/1987 | Tanino et al. | |
| 4,698,259 | A | | 10/1987 | Hervey | |
| 4,738,034 | A | | 4/1988 | Muramatsu et al. | |
| 4,766,030 | A | | 8/1988 | Hervey | |
| 4,946,624 | A | | 8/1990 | Michael | |
| 4,983,814 | A | | 1/1991 | Ohgushi et al. | |
| 5,006,778 | A | | 4/1991 | Bashark | |
| 5,013,846 | A | | 5/1991 | Walley | |
| 5,047,255 | A | | 9/1991 | Fujita | |
| 5,055,171 | A | | 10/1991 | Peck | |
| 5,101,575 | A | | 4/1992 | Bashark | |
| 5,112,688 | A | | 5/1992 | Michael | |
| 5,126,061 | A | | 6/1992 | Michael | |
| 5,140,493 | A | | 8/1992 | Janicek | |
| 5,154,841 | A | | 10/1992 | Tucker et al. | |
| 5,166,592 | A | | 11/1992 | Bashark | |
| 5,172,490 | A | | 12/1992 | Tatsumi et al. | |
| 5,200,108 | A | | 4/1993 | Yuasa et al. | |
| 5,207,933 | A | | 5/1993 | Trinh et al. | |
| 5,211,827 | A | | 5/1993 | Peck | |
| 5,228,212 | A | | 7/1993 | Turetta et al. | |
| 5,232,612 | A | | 8/1993 | Trinh et al. | |
| 5,232,613 | A | | 8/1993 | Bacon et al. | |
| 5,234,611 | A | | 8/1993 | Trinh et al. | |
| 5,236,615 | A | | 8/1993 | Trinh et al. | |
| 5,254,285 | A | | 10/1993 | Fujita | |
| 5,281,956 | A | | 1/1994 | Bashark | |
| 5,301,438 | A | | 4/1994 | Tanaka et al. | |
| 5,332,521 | A | | 7/1994 | Yuasa et al. | |
| 5,355,425 | A | | 10/1994 | Braiman et al. | |
| 5,367,265 | A | | 11/1994 | Gaudette | |
| 5,367,429 | A | | 11/1994 | Tsuchitani et al. | |
| 5,397,499 | A | | 3/1995 | Fujita | |
| 5,454,171 | A | | 10/1995 | Ikeda et al. | |
| 5,465,197 | A | | 11/1995 | Chien | |
| 5,482,792 | A | | 1/1996 | Faita et al. | |
| 5,487,844 | A | | 1/1996 | Fujita | |
| 5,500,629 | A | | 3/1996 | Meyer | |
| 5,516,473 | A | | 5/1996 | Bakeev et al. | |
| 5,564,831 | A | | 10/1996 | Bashark | |
| 5,565,072 | A | | 10/1996 | Faita et al. | |
| 5,567,144 | A | | 10/1996 | McCoy | |
| 5,570,520 | A | | 11/1996 | Huffington | |
| 5,578,388 | A | | 11/1996 | Faita et al. | |
| 5,625,915 | A | | 5/1997 | Radler et al. | |
| 5,737,852 | A | | 4/1998 | Shukla et al. | |
| 5,767,062 | A | | 6/1998 | Trinh et al. | |
| 5,768,730 | A | | 6/1998 | Matsumoto et al. | |
| 5,804,219 | A | | 9/1998 | Trinh et al. | |
| 5,869,442 | A | | 2/1999 | Srinivas et al. | |
| 5,887,456 | A | | 3/1999 | Tanigawa et al. | |
| 5,899,684 | A | | 5/1999 | McCoy et al. | |
| 5,905,620 | A | | 5/1999 | Becher et al. | |
| 5,932,253 | A | | 8/1999 | Trinh et al. | |
| 5,940,986 | A | | 8/1999 | Jelinek et al. | |
| 5,962,400 | A | | 10/1999 | Thomaides et al. | |
| 5,972,196 | A | | 10/1999 | Murphy et al. | |

6,006,387 A 12/1999 Cooper et al.
6,020,698 A 2/2000 Stenger et al.
6,032,494 A 3/2000 Tanigawa et al.
6,047,486 A 4/2000 Reck et al.
6,074,200 A 6/2000 Bowman et al.
6,083,892 A 7/2000 Severns et al.
6,098,306 A 8/2000 Ramsey et al.
6,098,310 A 8/2000 Chen et al.
6,099,295 A 8/2000 McCoy et al.
6,115,862 A 9/2000 Cooper et al.
6,126,312 A 10/2000 Sakai et al.
6,132,492 A 10/2000 Hultquist et al.
6,139,311 A 10/2000 Bowman et al.
6,160,110 A 12/2000 Thomaides et al.
6,197,858 B1 3/2001 Hagano et al.
6,204,180 B1 3/2001 Tom et al.
6,235,914 B1 5/2001 Steiger et al.
6,246,040 B1 6/2001 Gunn
6,267,864 B1 7/2001 Yadav et al.
6,387,241 B1 5/2002 Murphy et al.
6,388,185 B1 5/2002 Fleurial et al.
6,420,507 B1 7/2002 Kale et al.
6,428,717 B1 8/2002 Sakai et al.
6,493,963 B1 12/2002 England
6,519,871 B2 2/2003 Gardner et al.
6,531,704 B2 3/2003 Yadav et al.
6,554,608 B1 4/2003 Bowman et al.
6,555,945 B1 4/2003 Baughman et al.
6,589,312 B1 7/2003 Snow et al.
6,620,210 B2 9/2003 Murphy et al.
6,654,549 B1 11/2003 Konishi
6,656,570 B1 12/2003 Fels et al.
6,736,997 B2 5/2004 Olding et al.
6,787,691 B2 9/2004 Fleurial et al.
6,840,069 B2 1/2005 France et al.
6,845,217 B2 1/2005 Konishi
6,845,290 B1 1/2005 Wunderlin et al.
6,868,289 B2 3/2005 Palti
6,879,424 B2 4/2005 Vincent et al.
6,906,842 B2 6/2005 Agrawal et al.
6,922,017 B2 7/2005 Konishi et al.
6,931,759 B2 8/2005 Jeong et al.
6,941,674 B2 9/2005 Park et al.
6,954,995 B2 10/2005 Kitamura et al.
6,968,632 B2 11/2005 Guinibert et al.
6,983,552 B2 1/2006 Park
7,013,578 B2 3/2006 Wunderlin et al.
7,020,982 B2 * 4/2006 Park et al. ..... 34/496
7,040,101 B2 5/2006 Takeda et al.
7,043,855 B2 5/2006 Heilman et al.
7,047,663 B2 5/2006 Zhang et al.
7,065,905 B2 6/2006 Guinibert et al.
7,081,225 B1 7/2006 Hollander
7,089,054 B2 8/2006 Palti
7,117,613 B2 10/2006 Guinibert et al.
7,118,611 B2 10/2006 Snow et al.
7,127,832 B2 10/2006 Park et al.
7,134,857 B2 11/2006 Andrady et al.
7,136,699 B2 11/2006 Palti
7,146,210 B2 12/2006 Palti
7,146,749 B2 12/2006 Barron et al.
7,160,297 B2 1/2007 Nesbitt
7,184,656 B2 2/2007 Konishi
7,225,562 B2 6/2007 Guinibert et al.
7,236,271 B2 6/2007 Silverbrook
7,257,905 B2 8/2007 Guinibert et al.
7,267,597 B2 9/2007 Konishi et al.
7,268,190 B2 9/2007 Ohme et al.
7,288,091 B2 10/2007 Nesbitt
7,291,570 B1 11/2007 Green et al.
7,312,973 B2 12/2007 Sekoguchi et al.
7,320,184 B2 1/2008 Zhang et al.
7,322,126 B2 1/2008 Beaulac
7,327,087 B2 2/2008 Wang
7,353,624 B2 4/2008 Chung et al.
7,375,342 B1 5/2008 Wedding
7,390,326 B2 6/2008 Nesbitt
7,392,950 B2 7/2008 Walmsley et al.
7,393,699 B2 7/2008 Tran
7,412,783 B2 8/2008 Guinibert et al.
7,415,781 B2 8/2008 Barron et al.
7,432,725 B2 10/2008 Sieh et al.
7,442,401 B2 10/2008 Tomaru
7,466,444 B2 12/2008 Silverbrook et al.
7,467,011 B2 12/2008 Palti
7,467,483 B2 12/2008 Guinibert et al.
7,478,486 B2 1/2009 Wunderlin et al.
7,503,127 B2 3/2009 DuVal et al.
7,519,420 B2 4/2009 Palti
7,524,593 B2 4/2009 Ohnuma
7,526,879 B2 5/2009 Bae et al.
7,530,670 B2 5/2009 Matsushita et al.
7,534,401 B2 5/2009 Keppel et al.
7,550,541 B2 6/2009 Ohme et al.
7,553,371 B2 6/2009 Dubrow et al.
7,565,205 B2 7/2009 Palti
7,565,206 B2 7/2009 Palti
7,567,740 B2 7/2009 Bayindir et al.
7,579,224 B2 8/2009 Kuwabara et al.
7,588,970 B2 9/2009 Ohnuma et al.
7,592,277 B2 9/2009 Andrady et al.
7,599,745 B2 10/2009 Palti
7,600,402 B2 10/2009 Shin et al.
7,605,410 B2 10/2009 Takano et al.
7,618,684 B2 11/2009 Nesbitt
7,624,601 B2 12/2009 Ikemizu et al.
7,628,467 B2 12/2009 Silverbrook
7,632,740 B2 12/2009 Aoki et al.
7,635,889 B2 12/2009 Isa et al.
7,655,566 B2 2/2010 Fujii
7,662,468 B2 2/2010 Bainbridge
7,687,326 B2 3/2010 Morisue et al.
7,700,932 B2 4/2010 Tomaru
7,706,890 B2 4/2010 Palti
7,715,036 B2 5/2010 Silverbrook et al.
7,723,205 B2 5/2010 Kakehata
7,732,330 B2 6/2010 Fujii
7,732,349 B2 6/2010 Yamamoto
2001/0000889 A1 5/2001 Yadav et al.
2002/0004995 A1 1/2002 France et al.
2002/0096984 A1 7/2002 Konishi et al.
2002/0145134 A1 10/2002 Olding et al.
2002/0171081 A1 11/2002 Vincent et al.
2002/0174564 A1 11/2002 England
2002/0179124 A1 12/2002 Van Hauwermeiren et al.
2002/0184789 A1 12/2002 Gardner et al.
2003/0039729 A1 2/2003 Murphy et al.
2003/0041892 A1 3/2003 Fleurial et al.
2003/0050220 A1 3/2003 Trinh et al.
2003/0082972 A1 5/2003 Monfalcone et al.
2003/0109400 A1 6/2003 Murphy et al.
2003/0227664 A1 12/2003 Agrawal et al.
2004/0007000 A1 1/2004 Takeda et al.
2004/0035717 A1 2/2004 Yamamoto et al.
2004/0037542 A1 2/2004 Kanishi
2004/0048754 A1 3/2004 Herrmann et al.
2004/0055176 A1 3/2004 Yang et al.
2004/0060197 A1 4/2004 Jeong et al.
2004/0068295 A1 4/2004 Palti
2004/0068296 A1 4/2004 Palti
2004/0068297 A1 4/2004 Palti
2004/0073104 A1 * 4/2004 Brun del Re et al. ..... 600/372
2004/0089058 A1 5/2004 De Haan
2004/0096169 A1 5/2004 Sone
2004/0096202 A1 5/2004 Konishi
2004/0116792 A1 6/2004 Nesbitt
2004/0134090 A1 7/2004 Heilman et al.
2004/0143994 A1 7/2004 Baron et al.
2004/0152381 A1 8/2004 York et al.
2004/0168344 A1 9/2004 Park
2004/0172985 A1 9/2004 Mamiya et al.
2004/0175163 A1 9/2004 Fukai
2004/0176804 A1 9/2004 Palti
2004/0200093 A1 10/2004 Wunderlin
2004/0213899 A1 10/2004 Wang
2004/0216326 A1 11/2004 Kitamura et al.
2004/0237338 A1 12/2004 Rump et al.
2004/0242803 A1 12/2004 Ohme et al.

2004/0259750 A1 12/2004 DuVal et al.
2005/0022311 A1 2/2005 Zhang et al.
2005/0025956 A1 2/2005 Bainbridge
2005/0050758 A1 3/2005 Park et al.
2005/0050763 A1 3/2005 Park et al.
2005/0076535 A1 4/2005 Guinibert et al.
2005/0091878 A1 5/2005 Yang et al.
2005/0091879 A1 5/2005 DuVal et al.
2005/0092035 A1 5/2005 Shin et al.
2005/0115104 A1 6/2005 Guinibert et al.
2005/0136785 A1 6/2005 Konishi et al.
2005/0137542 A1 6/2005 Underhill et al.
2005/0168907 A1 8/2005 Sekoguchi et al.
2005/0179761 A1 8/2005 Tomaru
2005/0188471 A1 9/2005 Ahn et al.
2005/0197158 A1 9/2005 Silverbrook et al.
2005/0199408 A1 9/2005 Keppel et al.
2005/0200635 A1 9/2005 Silverbrook
2005/0200636 A1 9/2005 Silverbrook
2005/0200638 A1 9/2005 Silverbrook
2005/0209640 A1 9/2005 Palti
2005/0209641 A1 9/2005 Palti
2005/0209642 A1 9/2005 Palti
2005/0216291 A1 9/2005 Shaheen et al.
2005/0224998 A1 10/2005 Andrady
2005/0240173 A1 10/2005 Palti
2005/0240228 A1 10/2005 Palti
2005/0241666 A1 11/2005 Bodet et al.
2005/0252028 A1 11/2005 Park et al.
2005/0278974 A1 12/2005 Chung
2006/0091398 A1 5/2006 Yamaguchi et al.
2006/0096117 A1 5/2006 Chung et al.
2006/0101943 A1 5/2006 Snow et al.
2006/0103316 A1 5/2006 Wang
2006/0115983 A1 6/2006 Fujii
2006/0116000 A1 6/2006 Yamamoto
2006/0123654 A1 6/2006 Zhang et al.
2006/0139409 A1 6/2006 Matsushita et al.
2006/0162180 A1 7/2006 Heilman et al.
2006/0163743 A1 7/2006 Kuwabara et al.
2006/0166411 A1 7/2006 Morisue et al.
2006/0167499 A1 7/2006 Palti
2006/0170077 A1 8/2006 Aoki et al.
2006/0170111 A1 8/2006 Isa et al.
2006/0185403 A1 8/2006 Ikemizu et al.
2006/0186222 A1 8/2006 Ikemizu et al.
2006/0191161 A1 8/2006 Wunderlin et al.
2006/0204911 A1 9/2006 Teng
2006/0228435 A1 10/2006 Andrady
2006/0233867 A1 10/2006 Palti
2006/0237019 A1 10/2006 Palti
2006/0241547 A1 10/2006 Palti
2006/0242858 A1 11/2006 Beaulac
2006/0248746 A1* 11/2006 Dittmer et al. ..... 34/534
2006/0249588 A1 11/2006 Walmsley et al.
2006/0250461 A1 11/2006 Silverbrook et al.
2006/0264140 A1 11/2006 Andrady et al.
2006/0272177 A1 12/2006 Pezier et al.
2006/0278875 A1 12/2006 Ohnuma et al.
2006/0293151 A1 12/2006 Rast
2007/0000068 A1 1/2007 France et al.
2007/0001225 A1 1/2007 Ohnuma et al.
2007/0004202 A1 1/2007 Fujii
2007/0006477 A1 1/2007 Guinibert et al.
2007/0026580 A1 2/2007 Fujii
2007/0028310 A1 2/2007 Palti
2007/0033660 A1 2/2007 Palti
2007/0037069 A1 2/2007 Ohnuma
2007/0037070 A1 2/2007 Ohnuma et al.
2007/0069401 A1 3/2007 Kakehata
2007/0094888 A1 5/2007 Barron et al.
2007/0101602 A1 5/2007 Bae et al.
2007/0106294 A1 5/2007 Nesbitt
2007/0108068 A1 5/2007 Suh
2007/0111391 A1 5/2007 Aoki
2007/0120095 A1 5/2007 Gruner
2007/0123853 A1 5/2007 Nesbitt
2007/0144031 A1 6/2007 Lee
2007/0153353 A1 7/2007 Gruner
2007/0153362 A1 7/2007 Gruner
2007/0153363 A1 7/2007 Gruner
2007/0163056 A1 7/2007 Lee et al.
2007/0170071 A1 7/2007 Suh et al.
2007/0182976 A1 8/2007 Silverbrook
2007/0186440 A1 8/2007 Guinibert et al.
2007/0190880 A1 8/2007 Dubrow et al.
2007/0193279 A1 8/2007 Yoneno et al.
2007/0194323 A1 8/2007 Takano et al.
2007/0214678 A1 9/2007 Son et al.
2007/0216424 A1 9/2007 Sieh et al.
2007/0220683 A1 9/2007 Kim
2007/0220776 A1 9/2007 Guinibert et al.
2007/0243124 A1 10/2007 Baughman et al.
2007/0260019 A1 11/2007 Ohme et al.
2007/0285843 A1 12/2007 Tran
2007/0295973 A1 12/2007 Jinbo et al.
2008/0032060 A1 2/2008 Nesbitt
2008/0050509 A1 2/2008 Nesbitt
2008/0052951 A1 3/2008 Beaulac
2008/0052954 A1 3/2008 Beaulac
2008/0107822 A1* 5/2008 Selwyn et al. ..... 427/535
2008/0134445 A1 6/2008 Cho et al.
2008/0138651 A1 6/2008 Doi et al.
2008/0141550 A1 6/2008 Bae et al.
2008/0148494 A1 6/2008 Son et al.
2008/0148596 A1 6/2008 Son et al.
2008/0161046 A1 7/2008 Walmsley et al.
2008/0168679 A1 7/2008 Son et al.
2008/0170982 A1 7/2008 Zhang et al.
2008/0176046 A1 7/2008 Yamaguchi et al.
2008/0180026 A1 7/2008 Kondo et al.
2008/0182076 A1 7/2008 Kondo et al.
2008/0184588 A1 8/2008 Somod et al.
2008/0236208 A1* 10/2008 Miyata et al. ..... 68/5 C
2008/0268732 A1 10/2008 Green et al.
2008/0289971 A1 11/2008 Shigihara et al.
2008/0296555 A1 12/2008 Miller et al.
2008/0299006 A1 12/2008 Ikemizu
2008/0302138 A1 12/2008 Bae et al.
2008/0305240 A1 12/2008 Tomaru
2008/0307667 A1 12/2008 Ikemizu
2008/0313922 A1 12/2008 Bae et al.
2008/0319372 A1 12/2008 Palti et al.
2009/0000040 A1 1/2009 Ikemizu
2009/0001200 A1 1/2009 Imahori et al.
2009/0004822 A1 1/2009 Murakami et al.
2009/0010801 A1 1/2009 Murphy et al.
2009/0025250 A1 1/2009 Koo et al.
2009/0030132 A1 1/2009 Kumazawa et al.
2009/0038178 A1* 2/2009 Ahn et al. ..... 34/557
2009/0043346 A1 2/2009 Palti et al.
2009/0049709 A1 2/2009 Doh
2009/0061131 A1 3/2009 Monfalcone et al.
2009/0073325 A1 3/2009 Kuwabara et al.
2009/0074389 A1 3/2009 Noe et al.
2009/0083990 A1 4/2009 Bae et al.
2009/0097805 A1 4/2009 Bayindir et al.
2009/0098908 A1 4/2009 Silverbrook et al.
2009/0100882 A1 4/2009 Bae et al.
2009/0113745 A1 5/2009 Choi et al.
2009/0113755 A1 5/2009 Choi et al.
2009/0126220 A1 5/2009 Nawrot et al.
2009/0126222 A1 5/2009 Bae et al.
2009/0126420 A1 5/2009 Tsunemine et al.
2009/0133281 A1 5/2009 Yoon et al.
2009/0143227 A1 6/2009 Dubrow et al.
2009/0148342 A1 6/2009 Bromberg et al.
2009/0153762 A1 6/2009 Kuwabara et al.
2009/0158750 A1 6/2009 Rubin
2009/0169158 A1 7/2009 Bayindir et al.
2009/0172969 A1 7/2009 Kim
2009/0173082 A1 7/2009 Rubin
2009/0176073 A1 7/2009 Ohnuma
2009/0179092 A1 7/2009 Akisada et al.
2009/0183188 A1 7/2009 Ashizaki et al.
2009/0200948 A1 8/2009 Selwyn
2009/0216182 A1 8/2009 Lauchard et al.
2009/0225050 A1 9/2009 Toyomaki

| | | | |
|---|---|---|---|
| 2009/0233057 | A1 | 9/2009 | Aksay et al. |
| 2009/0243065 | A1 | 10/2009 | Sugino et al. |
| 2009/0255299 | A1 | 10/2009 | Hiro et al. |
| 2009/0260256 | A1 | 10/2009 | Beaulac |
| 2009/0265953 | A1 | 10/2009 | Bae et al. |
| 2009/0274985 | A1 | 11/2009 | McKnight et al. |
| 2009/0275678 | A1 | 11/2009 | Kumazawa et al. |
| 2009/0286147 | A1 | 11/2009 | Nakajima et al. |
| 2009/0288456 | A1 | 11/2009 | Bae et al. |
| 2009/0313848 | A1 | 12/2009 | Moschutz et al. |
| 2010/0000117 | A1 | 1/2010 | Choi et al. |
| 2010/0000269 | A1 | 1/2010 | Shin et al. |
| 2010/0011611 | A1 | 1/2010 | Kim et al. |
| 2010/0011614 | A1 | 1/2010 | Doh |
| 2010/0015764 | A1 | 1/2010 | Ohnuma et al. |
| 2010/0024462 | A1 | 2/2010 | Kamisako et al. |
| 2010/0038618 | A1 | 2/2010 | Takano et al. |
| 2010/0062569 | A1 | 3/2010 | Aoki et al. |
| 2010/0077770 | A1 | 4/2010 | Kamisako et al. |
| 2010/0077791 | A1 | 4/2010 | Kamisako et al. |
| 2010/0081471 | A1 | 4/2010 | Silverbrook |
| 2010/0081913 | A1 | 4/2010 | Cross |
| 2010/0085684 | A1 | 4/2010 | Suh |
| 2010/0099217 | A1 | 4/2010 | Isa |
| 2010/0149582 | A1 | 6/2010 | Silverbrook et al. |
| 2010/0242547 | A1 * | 9/2010 | Nakada et al. ..... 68/139 |
| 2010/0307724 | A1 | 12/2010 | Ichii et al. |

FOREIGN PATENT DOCUMENTS

| | | | | |
|---|---|---|---|---|
| JP | 60253164 | | | 12/1985 |
| JP | 06170096 | A | | 6/1994 |
| JP | 07229867 | | | 8/1995 |
| JP | 07229867 | A | * | 8/1995 |
| JP | 2002273099 | A | * | 9/2002 |
| JP | 2004248893 | A | * | 9/2004 |
| JP | 2010187742 | A | | 9/2010 |
| WO | WO2004059072 | | | 7/2004 |
| WO | WO 2004059072 | A1 | * | 7/2004 |

* cited by examiner

DEVICE FOR DETERMINING THE CONDUCTANCE OF LAUNDRY, DRYERS AND METHOD FOR PREVENTING DEPOSITS ON ELECTRODES

CROSS-REFERENCE TO RELATED APPLICATION

This application is a divisional, under 35 U.S.C. §121, of U.S. application Ser. No. 10/539,453, filed May 1, 2006, which is a U.S. national stage application under 35 U.S.C. §371 of PCT/EP2003/014177, filed Dec. 20, 2003, which designated the United States; this application also claims the priority, under 35 U.S.C. §119, to German Application No. 102 60 149.6, filed Dec. 20, 2002.

BACKGROUND OF THE INVENTION

The invention relates to a device for determining the conductance of laundry, a dryer and a method for preventing depositing on electrodes for conductance measuring.

In modern dryers, in particular in domestic dryers, the wash moisture in the laundry is measured for controlling the dryer, in particular for achieving desired residual moisture in the laundry. This measuring is preferably carried out according to the principle of conductance measuring.

As a rule two electrodes are applied to the laundry for this purpose, whereby one of the electrodes can represent for example the laundry drum and the second electrode can be a carrier installed against and insulated from the drum. Voltage is applied to the two electrodes via a resistor, and the result is a current through the laundry. The laundry voltage falling on the laundry is measured on the electrodes and from this determines the conductance, which is proportional to the moisture content in the laundry.

It was established in particular with fixed electrodes that a drift in measuring results had been set after repeated use. Tests have proven that this is caused by the development of deposits in the form of layers on the electrodes made by water contents and laundry substances. The transfer resistance occurring from the layers in addition is measured and the result of the wash moisture measuring is thus falsified by these layers, which for example can comprise lime and silicate, during measuring of the wash moisture. This means for example that targeted adjusting of residual moisture in the laundry is no longer guaranteed. On completion of the drying program the final residual moisture of the laundry is rather shifted in the direction of moister laundry. To remove the layers it was suggested to clean the electrode surfaces with acidic cleaning fluids so as to restore the functionality of the wash moisture measuring. This is expensive for one and also the electrodes can be difficult to access for the user, depending on the selected installation site.

BRIEF SUMMARY OF THE INVENTION

The object of the invention is therefore to provide a device for measuring the wash moisture, a laundry dryer and a process for preventing layer build-up on electrodes in a laundry dryer, by means of which the development of layers on electrodes can be prevented or at least sharply reduced such that also precise determining of the wash moisture is enabled after repeated use, without the electrodes having to be cleaned by the user. In addition the device and the laundry dryer should have a simple construction.

The idea of the invention is that through targeted adjusting of a certain temperature on the electrode surfaces the build-up of layers can be prevented or at least decreased.

This task is therefore solved according to the present invention by a device for determining the conductance of laundry in a laundry dryer, which comprises at least two electrodes, whereby the device comprises means for heat elimination from at least one part of at least one of the electrodes.

In dryers a receiving area for the laundry to be dried is provided, which generally is a laundry drum. Through providing means for heat elimination from at least one part of the electrodes at least the surface of at least one of the electrodes, which is facing the receiving area or respectively borders on the latter, can be cooled. This drop in temperature of the electrodes can prevent evaporation of water on the electrodes, which can lead to the build-up of deposits of water contents and laundry fluids residues. A build-up of layers, which falsify the measuring results of the conductance measuring, can thus be prevented. In addition the condensation of moist-warm air in the drum interior on the electrodes can lead to the solution of water and laundry fluid contents on the electrodes being diluted and the fallout of dissolved minerals is prevented.

With means for heat elimination being provided on the rear of the electrodes particularly simple and advantageous heat elimination is guaranteed.

In one embodiment the means for cooling the electrodes represent means for improving radiation of heat from the electrodes. This embodiment is offered in cases where the electrodes are installed in positions, in which the side of the electrodes, averted from the drum interior, borders on a space, in which a lower temperature prevails than in the laundry drum. So for example the rear of the electrodes, that is, the side of the electrodes, facing away from the inside of the laundry drum, can be provided with a black coating, by which the radiation of heat in this direction is improved. It is also possible to improve the heat radiation by roughening the rear of the electrodes.

Alternatively or in addition the means can have cooling surfaces, which are connected to the electrodes. These cooling surfaces can lead, either by heat radiation or by additional cooling of the cooling surfaces by an appropriate coolant, such as for example air, to lowering of the temperature of the electrodes, in particular of the surface of the electrodes facing the drum interior.

According to the present invention the means for cooling the electrodes can also comprise means for air supply. By guiding colder air from other parts of the dryer along or onto the electrodes, in particular along or onto the electrode surface, facing the drum, the temperature of the electrodes can be lowered.

According to a preferred embodiment the means for air supply are formed by defined faulty air openings in the vicinity of the electrodes. Ambient air can be conveyed to the electrodes via these faulty openings. In terms of this invention passages are designated as faulty air openings, via which colder air from other areas of the dryer or respectively from its surroundings can be conveyed to the electrodes. The faulty air openings can also be designed in the form of pipes. The faulty air openings however preferably constitute gaps.

The means can also comprise an additional fan for raising the flow speed, or a source of pressurised air.

The electrodes of the inventive device are particularly preferably fixed in the laundry dryer. Due to this configuration costly contacting of the electrode, as is required for online electrodes, can be omitted. With the inventive device depositing on the electrodes can be avoided, although the elimination of deposits does not apply to a large extent through friction with the laundry, which is moved in the drum, as this occurs with carrier electrodes.

According to a further aspect of the invention the problem is solved by a laundry dryer, which comprises at least one receiving area for laundry and at least two electrodes for measuring the conductance of the laundry, whereby at least one of the electrodes borders at least partially on the receiving area, whereby means are provided in the laundry dryer for cooling at least a part of at least one of the electrodes.

The means used in the laundry dryer for heat elimination can be designed as described in Claims 2 to 6. These can thus comprise means for improving the radiation of heat, cooling surfaces, means for air supply or respectively a fan or a source of compressed air.

In one embodiment, with the inventive laundry dryer, in particular with the dryer according to the exhaust air type, means are provided, by which subpressure can be adjusted in the receiving area of the dryer. In addition to this the means for cooling in this embodiment constitute defined faulty air openings, via which the electrodes can be supplied with ambient air. The air supply in the inventive laundry dryer can be adjusted ideally by providing means for generating subpressure.

Colder ambient air can reach the electrodes and in particular the electrode surface via this subpressure through the faulty air openings. A fan can be used for example to generate the subpressure.

The build-up of deposits on the electrodes can easily be prevented by this adjusting of the air current into the laundry dryer.

The electrodes are preferably installed fixed in the laundry dryer.

The latter are arranged particularly preferably in the region of the front end shield. In this configuration the inventive effect of preventing the build-up on the electrodes can be utilised particularly advantageously, since other mechanisms can be utilised at this installation point only minimally for eliminating the layers, such as for example friction with the laundry in the drum.

The task is finally solved by a process for preventing layer deposits on electrodes for measuring moisture in a laundry dryer, whereby the temperature of the electrodes is controlled by means for heat elimination. The electrodes are preferably cooled at least partially by this.

The means for heat elimination, which can be used according to the present invention for controlling heat elimination, can be designed as in Claims 2 to 6. These can thus comprise means for improving the radiation of heat, cooling surfaces, means for air supply or respectively a fan or a source of compressed air.

It is particularly preferable to bring the electrodes to a temperature, which is below the processing temperature in the laundry dryer, preferably below the temperature of surfaces, adjacent to the electrodes. The difference in temperature is preferably set at least at one degree Kelvin (1 K). Adjoining surfaces are for example the front floor or the front drum mantle of the laundry drum. Whereas on the relatively cooler electrodes solutions of water and laundry fluids contents optionally applied by the laundry through condensation of the moist warm air are diluted, on the relatively warmer metallic surfaces in the environment the solution of evaporating water is further concentrated, which leads to the depositing of minerals and thus to forming of layers on these relatively warmer surfaces. The electrode surfaces required for the conductance measuring however remain free of deposits.

Cooling of the electrodes can be achieved in different ways. In one embodiment the electrodes are cooled by air cooling. The particular advantage of this type of cooling in which a focused cool-air supply is directed to at least one part of the electrodes is that the air located in the dryer outside the laundry drum can be used as coolant can and thus bringing more coolant into the laundry dryer is unnecessary. For this reason a preferred embodiment of the process in particular in dryers according to the exhaust air type is characterised in that subpressure is adjusted in a receiving area for laundry in the laundry dryer and the electrodes are supplied with cool air, in that ambient air is sent to the electrodes via defined faulty air openings.

The advantages and characteristics of the inventive device or respectively of the inventive dryer apply accordingly also for the inventive process and vice versa respectively.

BRIEF DESCRIPTION OF THE DRAWINGS

The invention will be described hereinafter by means of the attached diagrams, which illustrate a non-limiting example of a possible embodiment of the invention, in which.

DETAILED DESCRIPTION OF EXEMPLARY EMBODIMENTS OF THE PRESENT INVENTION

Figure 1:
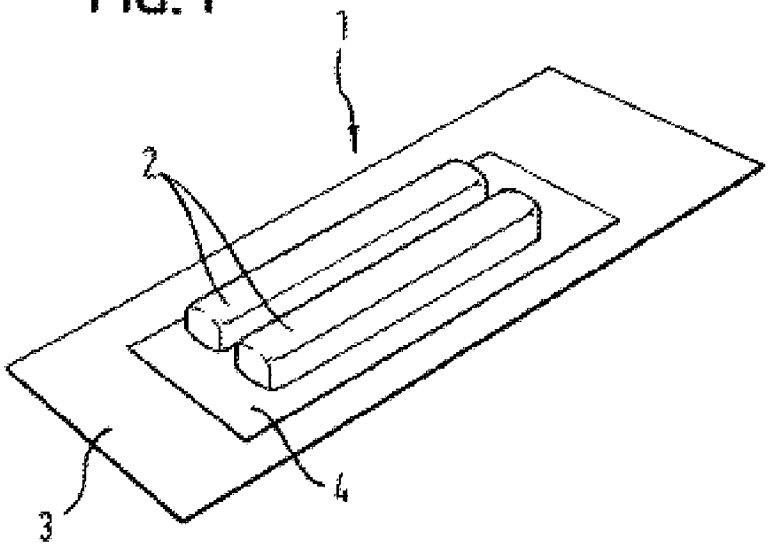
FIG. 1 is a perspective view of an embodiment of an inventive device for measuring wash moisture.

FIG. 1 illustrates an embodiment of an inventive device 1 in perspective view. Devices for measuring the conductance are known extensively from the prior art, so that in the figures only elements of the device are shown, which are essential to the invention. The device 1 comprises two electrodes 2, which extend in each case longitudinally and are arranged parallel to one another. The electrodes 2 are held on one component 3, whereby a retaining frame 4 is provided for fastening the electrodes 2. This can be connected so as to latch with the component 3. The component 3 can for example constitute the front end shield or respectively a part of the mounting of the drum. As is evident from FIG. 2, the component 3 in the illustrated embodiment has a depression 31, which corresponds to the size of the retaining frame 4 and serves to receive the retaining frame 4. Provided in the depression 31 are openings 32, which extend through the component 3 and are provided in the illustrated design in each case with pipe extensions 33. The pipe extensions 33 extend in the state in which the electrodes 2 are fastened to the component 3, in the interior of the electrodes 2.

Figure 2:
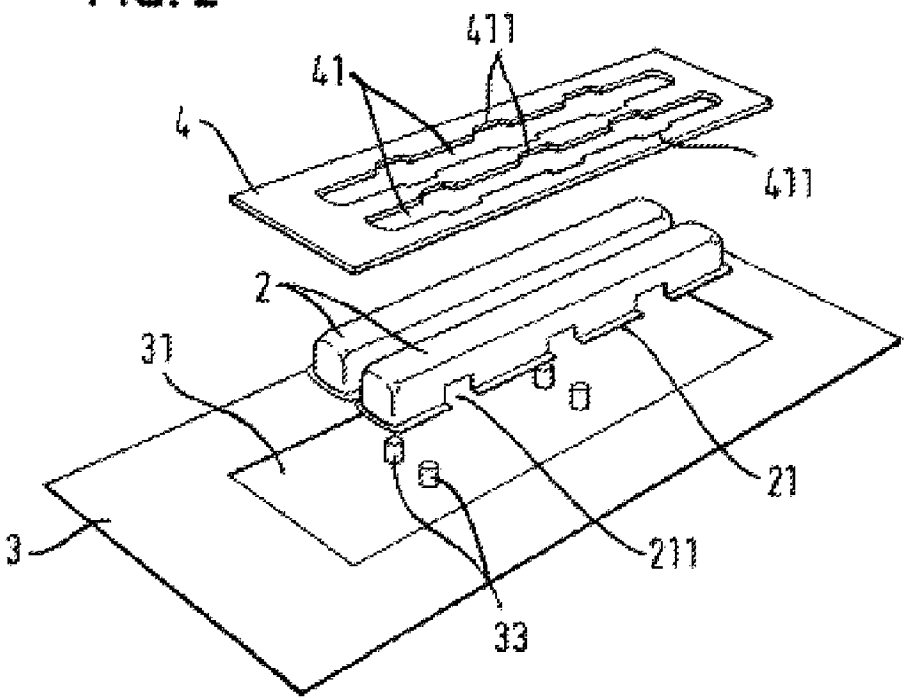
FIG. 2 is an exploded view of the embodiment of the inventive shown device in FIG. 1.
Figure 3:
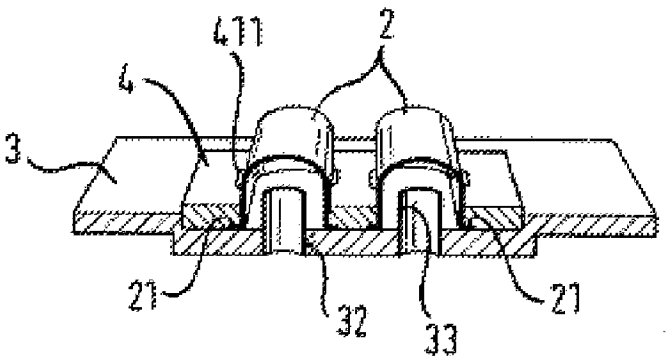
FIG. 3 is a schematic sectional view through the embodiment of the inventive device shown in FIG. 1.
Figure 4:
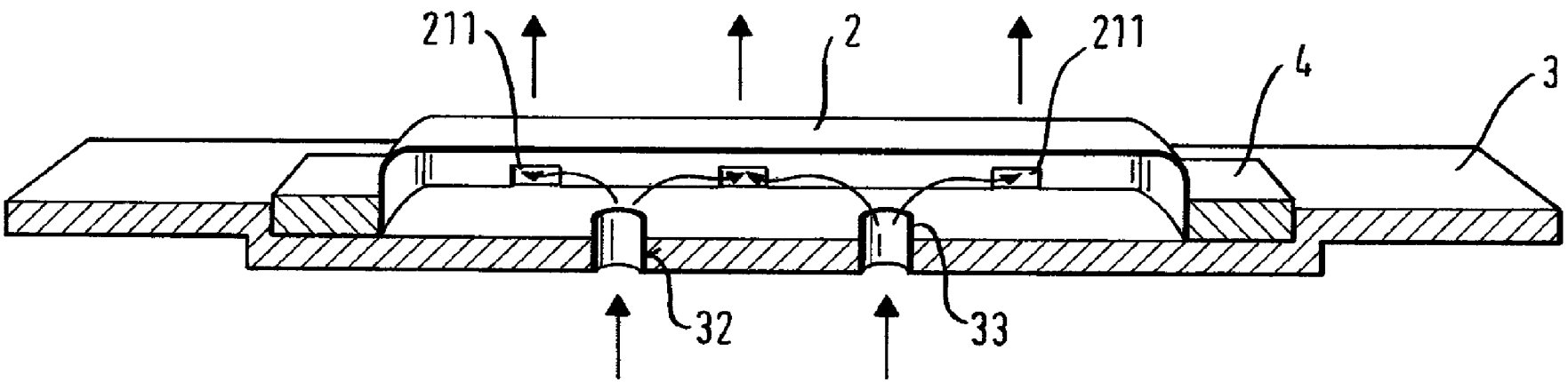
FIG. 4 is a schematic longitudinal view through the embodiment of the inventive device shown in FIG. 1.
Figure 6:
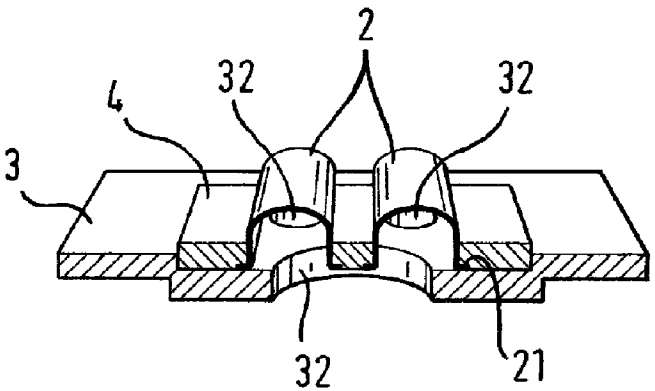
FIG. 5 to 7 illustrate an embodiment of an inventive device for measuring wash moisture compared to the modified device shown in FIGS. 2 to 4.
Figure 5:
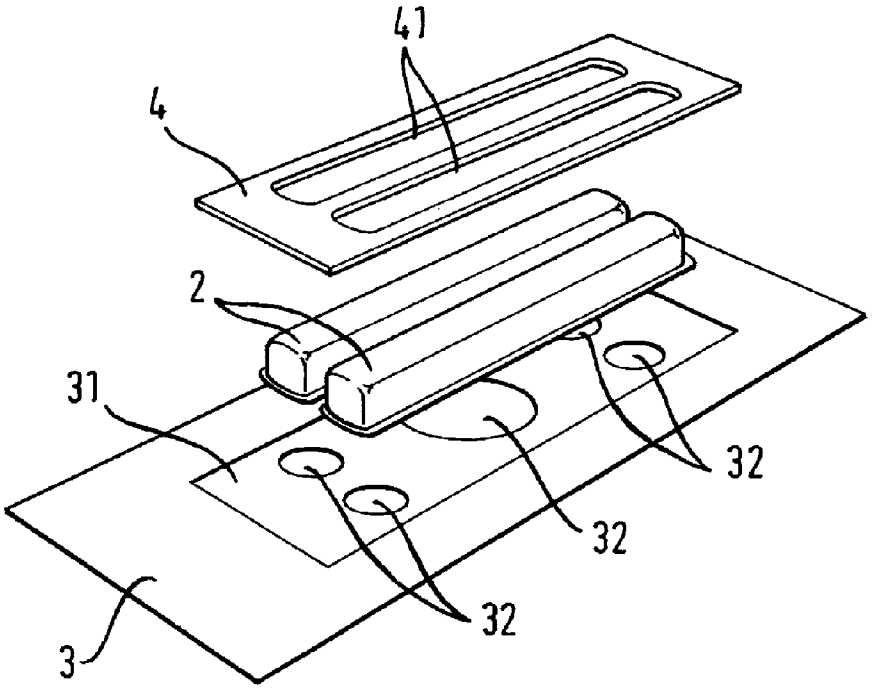
Figure 7:
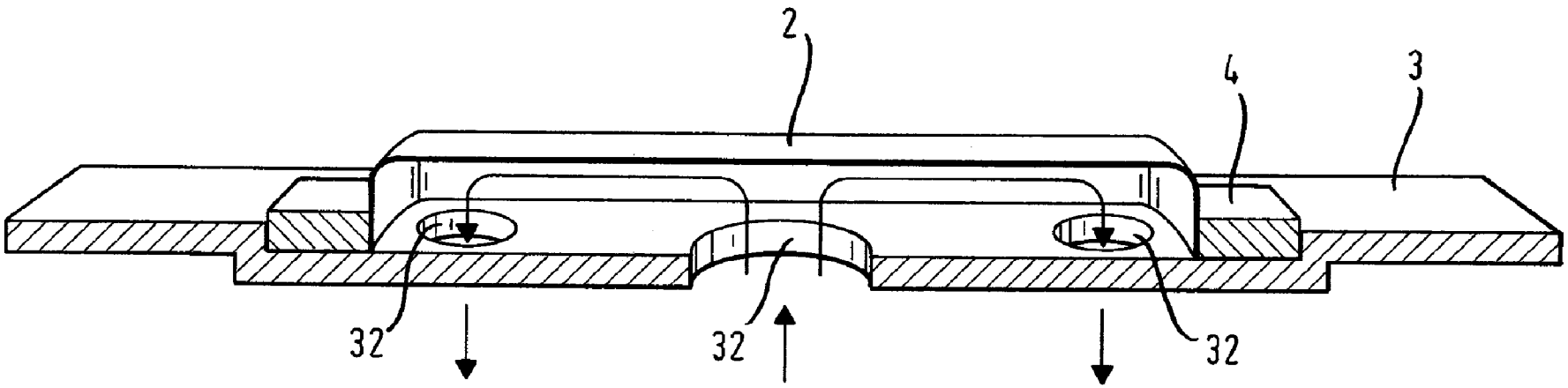

In contrast to the design illustrated in FIGS. 2 to 4 in FIGS. 5 to 7 the component 3 attached backwards to the electrodes 2 is provided with a central opening 32 for supplying cool air and with two side openings 32 for discharge of cool air. In this way the current of cool air enters in the centre and divides into two partial streams, so that uniform cooling of the electrodes is ensured.

The electrodes 2 in each case have a pan form, whereby the opening of the pan is facing the component 3. A flange 21, which is interrupted over the length of the electrodes 2 at several positions (in this case three) by recesses 211 extends outwards at the edge of the pan opening on each electrode 2. The recesses 211 preferably extend over the flange 21 in the direction of the pan floor of electrodes 2. The retaining frame 4 has two longitudinal grooves 41, corresponding to the form of the electrodes 2. Provided over the length of the longitudinal grooves 41 at positions, which correspond to the positions of the recesses 211 on the electrodes 2, are extensions 411 of the longitudinal groove 41.

As shown in FIG. 3, in the assembled state the pipe extensions 33, which are provided on the component 3, project into the interior of the electrodes 2, i.e. in the pan form, but do not contact the pan floor.

FIG. 4 shows a longitudinal section through the embodiment of the device 1 shown in FIG. 1. An embodiment of the inventive process will now be explained with reference to this diagram.

In a laundry dryer according to the exhaust air type, which works on the suction principle, a certain subpressure prevails in the laundry drum determined by the type of construction. Using the inventive device 1 in such a laundry dryer results in the following current behaviour. Colder air outside the drum is directed via the openings 32 in the component 3 and via the connected pipe extensions 33 into the interior of the pan-shaped electrodes 2. There the air flow is directed via the extensions 411 of the longitudinal grooves 41 in the retaining frame 4 thus cooperating via the recesses 211 on the electrodes 2 into the interior 5 of the laundry drum. By way of this air supply the inside of the electrodes is kept constantly cool. Each of the electrodes 2 experiences a certain cooling from this. In addition, the surface of the electrodes 2, facing the drum interior 5, is additionally cooled by cooler air brushing past this surface of the electrode 2. The cooling thus takes place via the channel formed by the openings 32, the pipe sections 33 and the inside of the electrodes 2, as well as via the defined gap leakage formed by the recesses 211 and extensions 411. This results in ideal cooling and fallout of minerals and the formation of layers, which falsify the measuring results, can thus be avoided.

Figure 8:
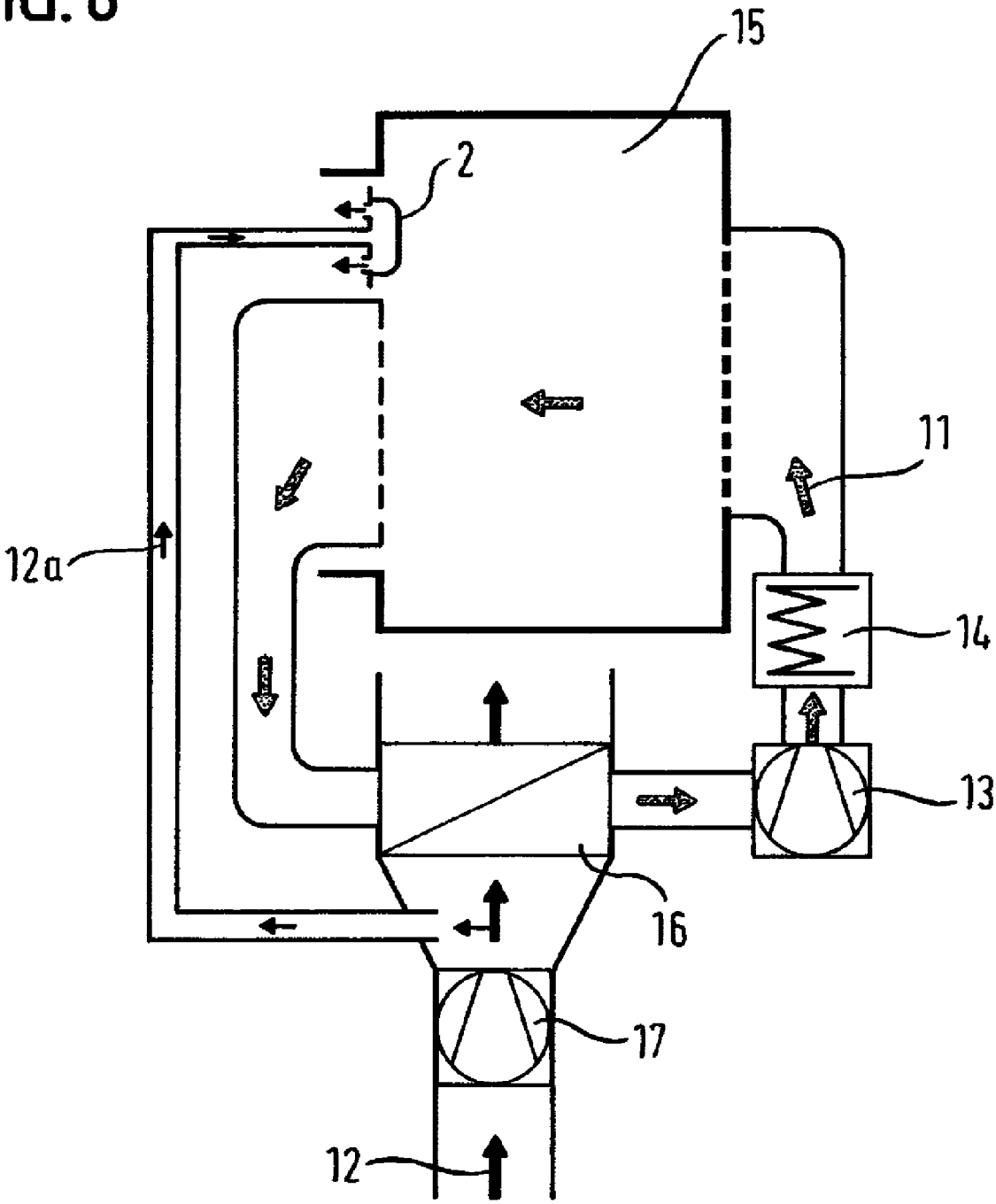
FIG. 8 shows a laundry dryer according to the condensation construction with an inventive device for measuring wash moisture.

FIG. 8 illustrates a laundry dryer according to the condensation type, which has a processing air stream 11 and a current of cool air 12 for cooling the processing air current 11. The processing air current 11 is guided via a fan 13, a heating unit 14, a drum 15, a slubbing sieve (not illustrated) and a condenser 16 in a closed circuit. The condenser 16 is cooled via the current of cool air 12 generated by means of a fan 17. A partial current of cool air 12*a* is branched off between the fan and the condenser from the current of cool air 12 and directed to the rear of the electrodes 2.

The current of cool air 12 for the condenser 16 can also be used for cooling the electrodes 2 in an advantageous manner.

The invention is not restricted to the illustrated embodiments. With the inventive device the air channel for flowing through the electrodes and flowing past the surface of the electrodes can also be formed by other means than the illustrated recesses and extensions. For example slots can be formed through which the colder air can reach the surface of the electrodes from the inside of the electrodes. Should the invention be realised on a dryer, which does not work according to the above suction principle, instead of using the subpressure in the laundry drum a fan can be used to guide cooler air to the electrodes from outside the drum via suitable channels or via defined gap leakages.

It is further possible to configure electrodes in such a way that they are provided on the side averted from the interior of the laundry drum with a coating, for example a black film, or cooling surfaces are provided on this side. If the electrodes are arranged for example in the region of the front end shield, these cooling surfaces can extend in the space between the end shield and the front wall of the unit.

Alternatively or additionally the flow rate of the air behind the electrodes can be increased, through which the elimination of heat of the electrodes can be increased and its temperature can thus be lowered.

With the inventive device, the laundry dryer and the inventive process a temperature difference between the electrodes and adjacent surfaces of at least 0.8 K, preferably at least 1 K and particularly preferably at least 1.2 K can preferably be set.

Also the form of the electrodes is not limited to the form in question. The electrodes can for example also be designed flat, or exhibit a v-shaped cross-section. Likewise, ways other than the above type of fastening of the electrodes can be used on the component. Known latching means can be considered for this purpose.

The cooling of the electrodes can, as can be inferred from the description, be carried out via direct cooling of the surface of the electrodes facing the drum interior. Alternatively or in addition to this the heat elimination and thus the cooling can take place indirectly via the rear side of the electrode.

In summary the present invention creates the possibility of reliably determining the conductance of laundry, which is to be dried in a dryer, without the user having to manually clean the electrodes used for measuring.

What is claimed is:

1. A laundry dryer, which comprises at least one receiving area for laundry and at least two electrodes for measuring the conductance of the laundry, whereby at least one of the electrodes at least partially borders on the receiving area, the laundry dryer including cooling means for cooling at least a part of at least one of the electrodes;

a laundry drum defining the receiving area for receiving laundry;

a sensor for measuring the amount of moisture in the laundry, the sensor including the at least one of the electrodes, the at least one of the electrodes having an outer surface exposed to the receiving area;

an air intake receiving a cool air flow; and an air passageway directing at least a portion of the cool air flow to the sensor to cool the at least one of the electrodes and resist formation of deposits on the at least one of the electrodes, wherein the sensor includes the at least one of the electrodes being connected to a base component defining an opening in fluid communication with the air passageway for providing the cool air flow to pass through the base component and contact the at least one of the electrodes, and the at least one of the electrodes is formed as an elongated trough-shaped member defining an internal cavity, the outer surface of the at least one of the electrodes facing away from the base component and the internal cavity facing toward the base component and being in fluid communication with the opening and receiving the cool air flow from the opening.

2. The laundry dryer as claimed in claim 1, wherein the cooling means are arranged on the rear of the electrodes.

3. The laundry dryer as claimed in claim 1, wherein the cooling means includes at least one of means for improving radiation of heat from the electrodes and cooling surfaces, which are connected to the electrodes.

4. The laundry dryer as claimed in claim 1, wherein the cooling means comprises air supply means for supplying the cool air flow and the base component is provided with a plurality of openings, the cool air flow being supplied to the electrodes through a middle opening and the cool air flow being removed from the electrodes through at least one side opening.

5. The laundry dryer as claimed in claim 4, wherein the air supply means include air openings adjacent the electrodes, the cool air flow being conveyed to the electrodes through the air openings.

6. The laundry dryer as claimed in claim 1, wherein cooling means includes an air supply means for providing a cool air flow, the air supply means including a sub-pressure being set in the receiving area, the cooling means including defined air openings adjacent the electrodes, the air supply means supplying cool air flow to the electrodes, the dryer comprising a condenser for condensing water, and the cool air flow passing through the condenser and at least a part of the cool air flow is also used for cooling the electrodes.

7. The laundry dryer as claimed in claim 1, wherein the electrodes are built in to the laundry dryer in the vicinity of a front end shield.

8. The laundry dryer as claimed in claim 1, wherein the at least one of the electrodes includes at least one gap permitting the cool air flow to pass from the at least one of the electrodes into the receiving area of the laundry drum.

9. The laundry dryer as claimed in claim 1, further comprising a pipe extension extending from the opening into the at least one of the electrodes to direct the cool air flow against the at least one of the electrodes.

10. The laundry dryer as claimed in claim 1, wherein the base component defines a side opening, the cool air flow entering the at least one of the electrodes through the opening and exiting the at least one of the electrodes through the side opening.

11. A process for preventing deposit build-up on electrodes for measuring the conductance of laundry in a laundry dryer, the process comprising:

providing in the laundry dryer a laundry drum that defines a receiving area for the laundry;

providing at least two of the electrodes for measuring the conductance of the laundry, whereby at least one of the electrodes at least partially borders on the receiving area;

providing the laundry drum with cooling means for cooling at least a part of at least one of the electrodes;

measuring the amount of moisture in the laundry with a sensor, the sensor including the at least one of the electrodes, the at least one of the electrodes having an outer surface exposed to the receiving area;

providing an air intake receiving a cool air flow; and directing at least a portion of the cool air flow through an air passageway to the sensor to cool the at least one of the electrodes and resist formation of deposits on the at least one of the electrodes, wherein the sensor includes the at least one of the electrodes being connected to a base component defining an opening in fluid communication with the air passageway for providing the cool air flow to pass through the base component and contact the at least one of the electrodes, and the at least one of the electrodes is formed as an elongated trough-shaped member defining an internal cavity, the outer surface of the at least one of the electrodes facing away from the base component and the internal cavity facing toward the base component and being in fluid communication with the opening and receiving the cool air flow from the opening.

12. The process as claimed in claim 11, wherein the cooling means is arranged on the rear of the electrodes.

13. The process as claimed in claim 11, wherein the cooling means includes at least one of means for improving radiation of heat from the electrodes and cooling surfaces, which are connected to the electrodes.

14. The process as claimed in claim 11, wherein the cooling means comprises means for air supply and the electrodes are arranged on a component in which openings are formed, cool air being supplied and removed from the electrodes, whereby the cool air is supplied through a middle opening and the cool air is removed through at least one side opening.

15. The process as claimed in claim 14, wherein the means for air supply are formed by defined air openings in the vicinity of the electrodes, through which ambient air can be conveyed to the electrodes.

16. The process as claimed in claim 14, wherein the means for air supply comprises at least one of a fan and a source of compressed air.

17. The process as claimed in claim 11, wherein the electrodes are brought to a temperature which is below a processing temperature in the laundry dryer and below a temperature of metallic parts adjacent to the electrodes.

18. The process as claimed in claim 11, wherein the electrodes are cooled by air cooling.

19. The process as claimed in claim 11, wherein sub-pressure is set in the receiving area for laundry in the laundry dryer and the electrodes are supplied with cool air, in that ambient air is guided to the electrodes through defined air openings.

20. The laundry dryer as claimed in claim 1, wherein the cooling means operates to reduce a temperature of a part of the at least one of the electrodes to a temperature which is below a temperature of a part of the receiving area that is adjacent to the part of the at least one of the electrodes.

* * * * *